United States Patent [19]

Makino et al.

[11] Patent Number: 4,608,228

[45] Date of Patent: Aug. 26, 1986

[54] Ni-Fe MAGNETIC HEAD INCLUDING 1.5-2% Ta

[75] Inventors: Akihiro Makino; Koichi Mukasa, both of Koide, Japan

[73] Assignee: Alps Electric Co., Ltd., Japan

[21] Appl. No.: 562,716

[22] Filed: Dec. 19, 1983

[30] Foreign Application Priority Data

Dec. 20, 1982 [JP] Japan ..... 57-222153

[51] Int. Cl.[4] ..... C22C 19/03

[52] U.S. Cl. ..... 420/459; 148/31.55

[58] Field of Search ..... 420/459; 148/31.55, 148/120, 426; 75/123 K, 123 J, 123 M

[56] References Cited

U.S. PATENT DOCUMENTS

| | | | |
|---|---|---|---|
| 3,785,880 | 1/1974 | Masumoto et al. | 420/459 |
| 3,794,530 | 2/1974 | Masumoto et al. | 148/31.55 |
| 3,837,933 | 9/1974 | Masumoto et al. | 148/120 |
| 4,007,006 | 2/1977 | Iijima et al. | 148/31.55 |
| 4,246,620 | 1/1981 | Kaminaka et al. | 360/127 |

FOREIGN PATENT DOCUMENTS

| | | | |
|---|---|---|---|
| 53-26994 | 3/1978 | Japan | 420/459 |
| 0123947 | 8/1982 | Japan | 148/31.55 |

*Primary Examiner*—L. Dewayne Rutledge
*Assistant Examiner*—Deborah Yee
*Attorney, Agent, or Firm*—Guy W. Shoup

[57] ABSTRACT

A magnetic head having excellent abrasion resistance and improved working life by using a core made of permalloy (Fe-Ni) comprising a ternary alloy, in which the tantalum content in the alloy is within a range from about 1.5% to about 3% by weight, or a quaternary or pentanary alloy, in which niobium or niobium and titanium is further contained in a slight amount.

1 Claim, 4 Drawing Figures

Ni-Fe MAGNETIC HEAD INCLUDING 1.5-2% Ta

BACKGROUND OF THE INVENTION (1) Field of the Invention

This invention concerns a magnetic head and, more specifically, it relates to the material for a magnetic core made of permalloy for use therewith.

(2) Description of the Prior Art

Permalloy (nickel-iron alloy) has a high magnetic permeability and can be worked with ease such as by rolling, punching or the like and is available at a low cost as well. However, since permalloy is not highly abrasion resistant, it can not provide a sufficient working life to magnetic heads when used as the core material therefor.

In order to obtain a magnetic core of a high hardness in order to overcome the foregoing defect, a nickel-iron alloy incorporated with tantalum within a range of 3.1-23.0% by weight has been proposed.

The inventors of this application have studied the effect of adding tantalum and, as the result, have found that although the hardness (Vickers hardness) of the alloy is increased approximately in proportion to the amount of tantalum added, the hardness of the alloy is not always correlated with the amount of abrasion of the magnetic core caused by frictional contact with, for example, a magnetic tape, and further that the magnetic property of the core such as the saturation magnetic flux density is undesirably reduced as the amount of tantalum added thereto increases.

SUMMARY OF THE INVENTION

Accordingly, it is an object of this invention to provide a magnetic head having a high saturation magnetic flux density and yet be excellent in the abrasion resistance.

The above object is attained in accordance with this invention by the use of a magnetic core made of permalloy comprising a ternary alloy consisting of nickel, iron and tantalum, in which the content of tantalum in the alloy is within a range from about 1.5% to about 3% preferably 1.5 to 2% by weight.

This invention further provides a magnetic head using a core made of permalloy comprising a quaternary alloy consisting of nickel, iron, tantalum and niobium, in which the content of tantalum in the alloy is within a range from about 1.5% to about 3% by weight and niobium is further contained in a slight amount therein.

This invention still further provides a magnetic head using a core made of permalloy comprising a pentanary alloy consisting of nickel, iron, tantalum, niobium and titanium, in which the content of tantalum in the alloy is within a range from about 1.5% to about 3% by weight and niobium and titanium are further contained each in a slight amount therein.

DESCRIPTION OF A PREFERRED EMBODIMENT

These and other objects, as well as advantageous features of this invention will become apparent by reading the specific explanation of the preferred embodiments of this invention in conjunction with the appended drawings.

Figure 1:
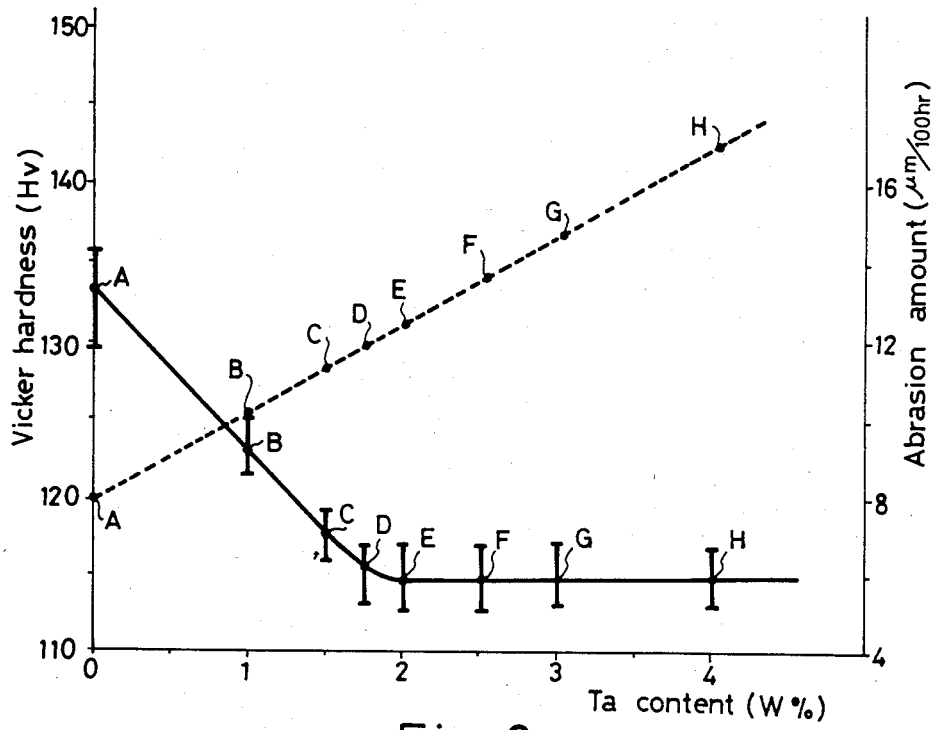
FIG. 1 is a characteristic curve for the hardness and the amount of abrasion of the permalloys having various composition ratios.

FIG. 1 shows the result of the measurement of the Vickers hardness and the amount of abrasion of ternary alloys consisting of nickel, iron and tantalum (Ni-Fe-Ta) while varying the tantalum content. Specifically, several samples of Ni-Fe-Ta ternary alloy are prepared while setting the Ni content as 80% by weight and the total content for Fe and Ta as 20% by weight and varying the value x (Ta content) along with the composition formula $Ni_{80}$-$(Fe_{20-x}$-$Ta_x)_{20}$ as shown by the following Table.

Table for Ni—Fe—Ta Ternary Alloy

| Sample symbol | Ta content (x value) | Composition ratio (w %) Ni | Fe | Ta |
|---|---|---|---|---|
| A | 0 | 80 | 20 | 0 |
| B | 1 | 80 | 19 | 1 |
| C | 1.5 | 80 | 18.5 | 1.5 |
| D | 1.7 | 80 | 18.3 | 1.7 |
| E | 2 | 80 | 18 | 2 |
| F | 2.5 | 80 | 17.5 | 2.5 |
| G | 3 | 80 | 17 | 3 |
| H | 4 | 80 | 16 | 4 |

The samples having the respective compositions are prepared from ingots which have been melted under vacuum in accordance with the composition ratios, by forging and rolling them into thin sheets of 100 μm thickness, which are then punched into the shape of a magnetic head core, annealed at 1150° C. for 2 hours in an atmoshere of hydrogen gas and, thereafter, cooled at a rate of 300° C./hour. The hardness of the samples are measured under the load of 100 g by using microvickers hardness meter. The result of the measurement for the hardness is shown by a broken line in FIG. 1, in which symbols attached to the broken line correspond to the sample symbols set forth in the composition table.

Thin alloy sheets punched to the shape of the head core are laminated by a predetermined number and assembled into magnetic heads respectively, which are incorporated into a recording and reproducing apparatus and actually operated in combination with commercially available magnetic tapes continuously for 100 hours. Then, the abrasion (abrased depth) is measured for each of the samples. The result of the measurement for the abrasion is shown by a solid line in FIG. 1, in which symbols attached to the solid line correspond respectively to the sample symbols as set forth in the composition table. Each of the samples is prepared by 8 pieces respectively and subjected to the measurement for the abrasion. Difference between the maximum value and the minimum value of the abrasion, that is, scattering in the abrasion amount is shown for each of the samples by the length of the segment in parallel with the ordinate in the graph and the average values for the abrasion amount are shown by black circular dots. The characteristic curve for the abrasion in the graph is prepared by connecting these circular dots.

Figure 2:
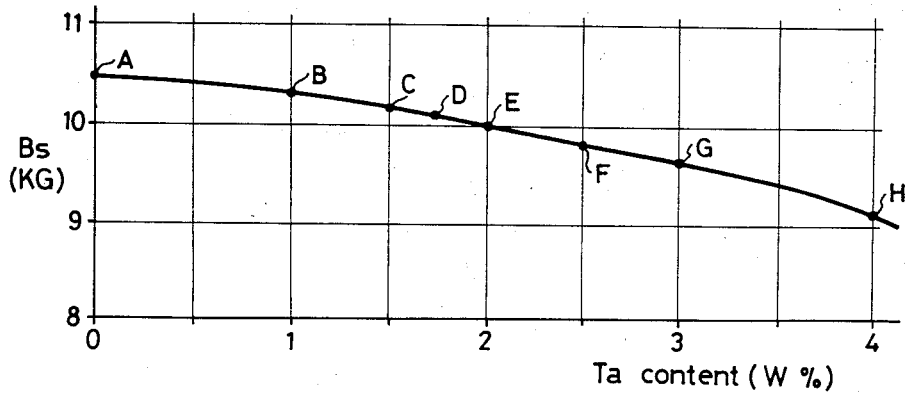
FIG. 2 is a characteristic curve for the saturation magnetic flux density of permalloys having different composition ratios.

As apparent from FIG. 1 although the hardness of the permalloy material increases in proportion to the increase in the tantalum content, the actual abrasion is rapidly decreased till the tantalum content of about 1.5% by weight and it scarcely changes after the tantalum content exceeds 2% by weight. In view of the characteristic abrasion curve at least 1.5% by weight tantalum has to be added The inventors have further studied on the relation between the tantalum content and the saturation magnetic flux density, the result of which is shown in FIG. 2. The saturation magnetic flux density is measured by the use of a vibratory magnetic force meter. The symbols attached to the magnetic flux density curve correspond respectively to the sample symbols as set forth in the composition table. As can be seen from the figure the saturation magnetic flux density is lowered as the tantalum content increases and, if the tantalum content exceeds 3% by weight, a high saturation magnetic flux density can not be maintained, excellent workability inherent to the permalloy is impared and the material cost is increased. In view of the foregoings, it is necessary to restrict the tantalum content in the alloy to a range from about 1.5% to about 3% by weight in order to obtain permalloy material which is inexpensive and excellent in the abrasion resistance while maintaining a high magnetic flux density and satisfactory workability.

As a result of various studies on additive elements to the Ni-Fe-Ta permalloy, the inventors have found that multi-elemental permalloy including Ni-Fe-Ta-Nb quaternary alloy incorporated with a minor amount of niobium and Ni-Fe-Ta-Nb-Ti pentanary alloy incorporated with a minor amount of niobium and titanium is particularly satisfactory in the abrasion resistance.

The examples (composition), the Vickers hardness (Hv), the abrasion amount and the saturation magnetic flux density (Bs) are measured for the multi-elemental permalloy and the results are shown in the following table. Measurement for the Vickers hardness, the abrasion amount and the saturation magnetic flux density are carried out under the same conditions as described above.

Table for the Compositions and Characteristics of Multi-elemental Alloy

| Composition ratio (w %) | | | | | | Abrasion amount | Bs |
|---|---|---|---|---|---|---|---|
| Ni | Fe | Ta | Nb | Ti | Hv | (μm) | (KG) |
| 80 | 17 | 2.5 | 0.5 | 0 | 136 | 5.0 | 9.4 |
| 80 | 17 | 2.1 | 0.9 | 0 | 137 | 5.1 | 9.3 |
| 80 | 17 | 2.1 | 0.5 | 0.4 | 135 | 5.0 | 9.2 |
| 80 | 17 | 2.1 | 0.3 | 0.6 | 134 | 5.5 | 9.15 |

-continued

Table for the Compositions and Characteristics of Multi-elemental Alloy

| Composition ratio (w %) | | | | | | Abrasion amount | Bs |
|---|---|---|---|---|---|---|---|
| Ni | Fe | Ta | Nb | Ti | Hv | (μm) | (KG) |
| 80 | 16.1 | 2.5 | 0.9 | 0.5 | 140 | 4.5 | 8.8 |
| 80 | 14.2 | 2.9 | 0.9 | 2.0 | 150 | 4.0 | 7.9 |

As apparent from the table, those Ni-Fe-Ta alloys further containing Nb or Nb and Ti have further higher abrasion resistance. While Ni-Fe-Nb ternary alloy prepared by adding Nb to Ni-Fe alloy has a higher hardness than Ni-Fe-Ta ternary alloy, it shows an increased abrasion. On the other hand, those prepared by adding Nb or Nb and Ti to Ni-Fe-Ta alloy have higher abrasion resistance than the ternary alloy as described above.

Also in the Ni-Fe-Ta-Nb quaternary alloy and the Ni-Fe-Ta-Nb-Ti pentanary alloy according to this invention, the Ta content is restricted within a range from about 1.5% to about 3.0% by weight. It is preferred to restrict the Nb content to a range from about 0.3% to about 1% by weight in view of the abrasion resistance, the magnetic property, the workability, etc. Further, it is desired to restrict the Ti content to a range from about 0.4% to about 2% by weight. Particularly, Ti content in excess of 2% by weight is undesired since a membrane is formed in this case on the surface during annealing to cause reduction of the magnetic property.

Figure 3:
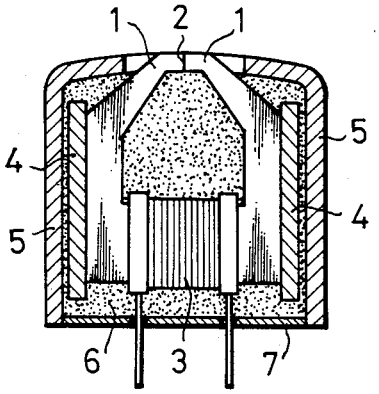
FIG. 3 is a cross sectional view of an acoustic magnetic head using a core material of a preferred embodiment of this invention.

FIG. 3 shows a cross sectional view of an acoustic head using a magnetic core made of the permalloy material as described above.

Bisected cores 1, 1 are prepared by laminating a predetermined number of thin sheets of the Ni-Fe-Ta permalloy as described above and a gap spacer 2 and exciting coils 3 are inserted at predetermined positions respectively between the opposing cores.

The assembly is contained within a hold case 4 and shield case 5, secured by injecting to solidify a synthetic resin 6 and disposed at the back thereof with a back shielding plate 7.

Figure 4:
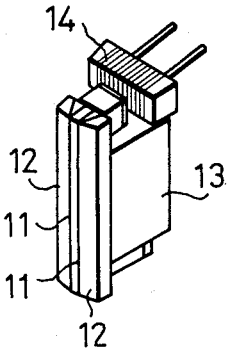
FIG. 4 is a perspective view of a magnetic head for VTR use using a core material of a preferred embodiment of this invention.

FIG. 4 is a perspective view for a VTR magnetic head which uses a core made of the permalloy as described above, with the casing being detached. The front core 12 having head gaps 11, 11 is composed of the Ni-Fe-Ta permalloy as described above and exciting coils 14 are disposed above the front core 12 and the back core 13.

The core material of this invention can also be used to other types of magnetic heads such as a magnetic disc head.

This invention having the foregoing construction can provide a magnetic head excellent in the abrasion resistance and having a long working life.

What is claimed is:

1. A magnetic head made of a Ni-based ternary alloy consisting only of nickel, iron and tantalum, in which the content of tantalum in the alloy is from about 1.5% to about 2% by weight.

* * * * *